United States Patent [19]

Bosnak

[11] 4,363,028

[45] Dec. 7, 1982

[54] ELECTRONIC SIREN

[75] Inventor: John J. Bosnak, Old Saybrook, Conn.

[73] Assignee: Whelen Engineering Company, Inc., Deep River, Conn.

[21] Appl. No.: 167,444

[22] Filed: Jul. 10, 1980

[51] Int. Cl.[3] ..... G08B 3/00

[52] U.S. Cl. ..... 340/384 E; 340/384 R

[58] Field of Search ..... 340/384 R, 384 E, 32, 340/33, 34, 405; 455/1, 58, 99

[56] References Cited

U.S. PATENT DOCUMENTS 4,075,624 2/1978 Sheff ..... 340/384 E

*Primary Examiner*—Marshall M. Curtis

*Assistant Examiner*—Daniel Myer

[57] ABSTRACT

An electronic siren-public address system with remote control capability. The siren-public address system employs a push-pull power amplifier wherein the output transistors are driven into saturation in the siren mode to minimize power dissipation in the power amplifier.

12 Claims, 4 Drawing Figures

ELECTRONIC SIREN

BACKGROUND OF THE INVENTION (1) Field of the Invention

This invention relates to the generation of audible alarm signals and particularly to the provision of an audible warning which, under the control of an operator, may comprise an amplified voice transmission or a tone which may be varied in frequency and/or repetition rate. More specifically, this invention is directed to communications apparatus which may function as a controllable electronic siren having several operating modes, a public address system or a means for retransmitting the information modulated on a radio frequency transmission. Accordingly, the general objects of the present invention are to provide novel and improved methods and apparatus of such character.

(2) Description of the Prior Art

Audio frequency communication systems capable of multimode operation are well known in the art. A typical utilization of such systems is on emergency vehicles wherein the capability of operating in a siren or public address mode is desired. It is also often desired that such systems, when in the siren mode, produce audible sounds having differing characteristics. Thus, the ability to change from the typical siren "wail" to a "yelp" mode when approaching an intersection is a common requirement. It is also often considered desirable to permit manual control over the tone generated by the siren and/or to provide an operating mode which simulates an air horn. A further feature often required is that the apparatus be capable of operating in a radio repeat mode. In a radio repeat mode calls transmitted by a dispatcher to the emergency vehicle will be amplified and "broadcast" by the siren speaker so that such calls may be heard by personnel who have left the vehicle.

While apparatus has previously been available to satisfy various of the above-discussed requirements, such apparatus has possessed certain deficiencies and limitations. A particularly significant problem has been precipitated by the energy cost dictated switch to smaller size vehicles which has imposed severe space limitations on the installation of electronic equipment. This problem cannot be solved merely by resort to miniaturization and, in fact, attempts to miniaturize equipment through resort to advances in solid state technology have produced equipment failure problems because of the inability to protect circuit components from overheating. Considering the significant power output levels required, potential component damage may result from a short-circuited load, unbalanced input to the power amplifier, operation at a very low frequency in the audio range and other problems.

A further problem in the prior art, which has become of significantly greater interest with increasing fuel costs, is power consumption. Suffice it to say that there is an intense desire in the art to minimize the electrical power consumed by communications apparatus thereby reducing vehicle engine loading and thus fuel consumption.

Still another problem, which has not been effectively solved in the prior art, is the provision of a remote control switch which automatically changes the operational mode of the apparatus. Again by way of example only, the driver of an emergency vehicle with the siren operating in the "wail" mode may wish to change to the "yelp" mode when approaching an intersection. It is desirable that this change be effected without having to divert attention from the road to a control panel. Most desirably, the change in output of the siren should be commanded by either a foot switch or a switch operated by the same control which operates the vehicle horn. However, because some vehicles have electrical systems with the positive terminal grounded whereas other vehicles have a negative ground system, the communications apparatus supplier has previously had to have two different type systems available and there have been the constant problems of equipment damage due to errors in ordering the appropriate apparatus for the particular vehicle.

An additional problem with prior art electronic sirens has resided in the utilization therein of comparatively complex circuitry, including mechanical switches, for changing operating mode and for switching capacitors into and out of the circuit in order to change the frequency of the tone generated by the device.

SUMMARY OF THE INVENTION

The present invention overcomes the above briefly-discussed and other deficiencies and disadvantages of the prior art by providing a novel and improved remotely controllable electronic siren and amplifier system primarily intended for installation on emergency vehicles. Apparatus in accordance with a preferred embodiment of the present invention includes an ultra compact control head assembly which may be mounted in any convenient location. The control head may, through the use of mode selection logic circuitry included therein, be employed to select the mode of operation of the system and, when the appropriate mode is selected, provide a path through which the output of a microphone or the intelligence transmitted to a radio receiver in the vehicle may be delivered to the siren power amplifier.

Apparatus in accordance with the present invention also includes a power amplifier module which includes the means for generating the audio frequency signal commensurate with the selected mode of operation. The power amplifier module includes solid state control logic circuitry, responsive to the output signals provided by the mode selection logic circuitry in the remote head, to control solid state switches to thereby select both the wave form and frequency of a signal delivered to a voltage controlled oscillator. The output of the voltage controlled oscillator, after appropriate processing, is delivered to the power amplifier in any of the siren modes.

Apparatus in accordance with the preferred embodiment of the present invention also includes a circuit which conditions signals received from a vehicle installed horn ring or foot operated switch. This signal conditioning circuitry provides, regardless of the type of electrical system in the vehicle, a control signal which will cause a change in operational mode. The mode to which the apparatus is switched will remain in effect until the horn ring or foot switch is operated a second time whereupon the system will revert to its original mode of operation. The two modes of operation controlled by the signal conditioning circuitry will, through operation of the logic circuitry in the power amplifier module, be a function of the setting of the selector switch on the remote control head.

A preferred embodiment of the present invention also comprises, at least in a manual mode of operation, protection circuitry which will prevent the application of an inappropriately low frequency signal to the input of the power amplifier. This low frequency cut-off circuit will thus prevent possible damage to the power amplifier components, and particularly the output transistors, which would result from the overheating incident to operating at a low frequency; i.e., a frequency below 300 Hz.

A particularly novel feature of the present invention resides in the unique power amplifier circuit which, in the siren mode of operation, insures that the power amplifier output transistors will be driven into saturation thereby minimizing resistance heating of these transistors and thus minimizing the possibility of damage thereto.

BRIEF DESCRIPTION OF THE DRAWING

The present invention will be better and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figures 1, 4:
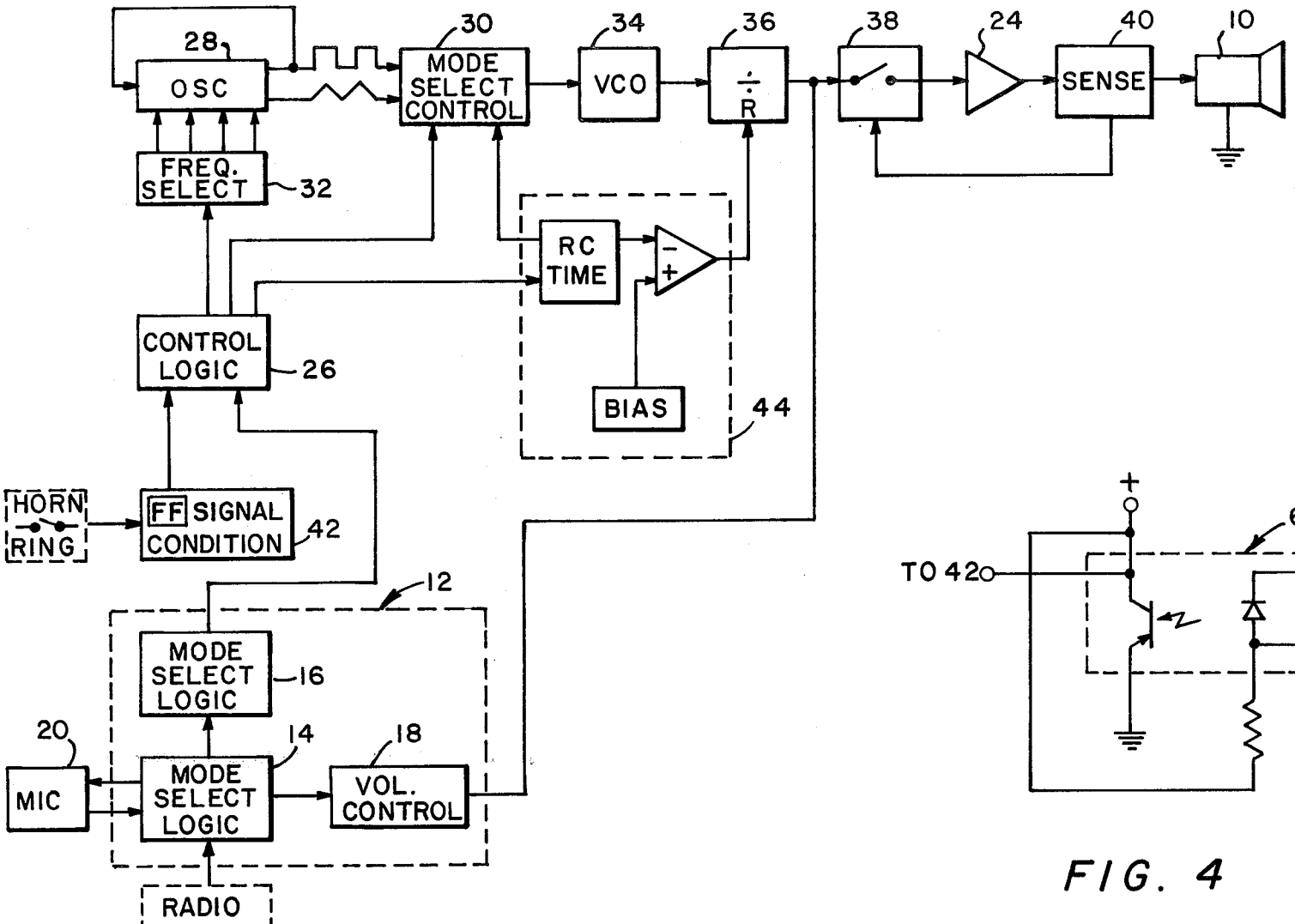
FIG. 1 is an electrical circuit block diagram of a preferred embodiment of the present invention.
FIG. 4 is a schematic diagram of the remote control switch signal conditioning circuit of the embodiment of FIG. 1.

With reference to the drawing, a block diagram of a sirenpublic address system in accordance with a preferred embodiment of the present invention is shown in FIG. 1. The system of FIG. 1 includes various subassemblies which provide a selected drive current to a loudspeaker 10 or array of speakers. A particularly unique feature of the present invention consists of a remote head, indicated generally at 12, which contains all of the controls for the system. This head 12 includes a mode selector switch 14, mode select logic circuitry 16, a volume control 18 and a main power switch, not shown. For voice communication, a microphone 20 may be plugged into head 12 and the circuitry is such that the microphone switch will cooperate with the mode selector switch 14 in the generation of the input signals to logic circuit 16. The audiooutput from a radio 22 may also be delivered to head 12. Depending upon the setting of switch 14, the audio frequency signal from either of microphone 20 or radio 22 will be passed, via volume control 18, to a power amplifier 24. The mode select logic circuit 16 will provide a coded output signal to control logic circuitry 26. The circuitry comprising a preferred embodiment of remote head 12, and the manner of operation of head 12, will be more fully explained below in the discussion of FIG. 2.

A system in accordance with the present invention further includes an oscillator 28. Oscillator 28 will provide a pair of output signals which, respectively, have a square and a triangular wave form. In accordance with one embodiment of the invention, oscillator 28 comprised a conventional triangular wave form generator with an RC timing circuit. The output of this oscillator is delivered directly to a selector circuit 30 and also to the input of a voltage sensitive flip-flop circuit; the flip-flop circuit providing the square wave output of oscillator 28. The output frequency of oscillator 28 is selected by placing the appropriate value of resistance in the oscillator RC timing circuit. This is accomplished by means of a plurality of normally "open" solid state switches, typically one for each of a "wail", "yelp", "air horn" and "hi-lo" mode, connected between a common timing capacitor and respective resistors. The state of these solid state switches, which comprise the frequency selector circuit 32, is supervised by the plural outputs of the control logic circuit 26 and thus is in part determined by the setting of the mode selector switch 14. The particular resistance placed in this circuit will, of course, control the rate at which the timing capacitor is charged and the signal commensurate with the charging of the timing capacitor, after amplification, is supplied as the low impedance triangular wave form output of oscillator 28. The charging voltage for the timing capacitor will comprise the square wave output of oscillator 28 which varies between 0 and a Vcc level as determined by the resistance placed in the circuit under the control of logic 26.

Either the square wave or triangular wave output of oscillator 28 is passed, by means of a mode select control circuit 30, to a voltage controlled oscillator 34. The mode select control 30, in a preferred embodiment, comprised three solid state switches which again under the supervision of the output of the control logic 26, pass either the square wave signal, the triangular wave form signal or a manually controlled ramp voltage to the input of oscillator 34. Oscillator 34 comprises a conventional voltage controlled oscillator which provides pulses at a repetition rate determined by the magnitude of the input voltage. The voltage controlled oscillator 34 will inherently provide an unsymmetrical output. Application of such an unsymmetrical signal to power amplifier 24, which is a class B push-pull amplifier, would result in unequal power dissipation whereby one of the power transistors would have a higher duty cycle than the other and could be damaged by overheating. Accordingly, the pulse train from amplifier 34 is delivered to a normally reset flip-flop circuit 36 which functions as a divide-by-two circuit to convert the oscillator output to a symmetrical square wave signal. This symmetrical square wave signal is delivered, via an over-current protection circuit 38, as the input to power amplifier 24. The over-current protection circuit may comprise a further solid state switch or an amplifier which is disabled upon the sensing of excessive load current. In either case, both the siren signal from divider 36 and the "voice" signals from remote head 12, when passed by protection circuit 38, are transformer coupled to power amplifier 24. The output of amplifier 24 is delivered, through the primary winding of a current sensing transformer 40, to speaker 10. Any excessive load current, indicative of the short-circuited load, will be sensed by transformer 40 and a control signal fed back to protection circuit 38 to disable amplifier 24 by removing the input signal from the amplifier.

The apparatus of FIG. 1 also comprises a remote control "switch" which, in a preferred embodiment, has the configuration depicted in FIG. 4. The remote control "switch" 42 will receive an input signal from either the vehicle horn "ring" operated switch or a driver operated foot switch. Regardless of the type of electrical system employed in the vehicle, the remote control "switch" 42 will respond to the switch closure commanded by the operator to produce an input to the control logic 26. This input will cause the setting of a bistable circuit. The output of this bistable circuit, through the operation of additional control logic, will cause the generation of control signals for the frequency selection circuit 32. In the typical instance, upon receipt of first input from remote control "switch" 42, the control logic 26 will command the frequency selection circuit 32 to remove the "long duration" triangular wave form input commensurate with the "wail" siren mode from oscillator 34 and apply the higher frequency triangular wave signal commensurate with the "yelp" mode to the oscillator. Thus, the output frequency of oscillator 28 will be changed by commanding the frequency selector circuit 32 to switch a different resistance into the timing circuit of oscillator 28. Upon receipt of a signal commensurate with the next closure of the operator controlled switch, the remote control "switch" 42 will provide a second input to control logic 26 which will cause resetting of the bistable circuit whereupon the system will return to the mode of operation established by the setting of the mode selector switch 14 in remote head 12. If a signal from remote control 42 is received when the system is in the "hi-lo" mode, the frequency of the square wave signal applied to oscillator 34 will be changed in the same manner as described above.

The preferred embodiment of the present invention also includes a low frequency protection circuit 44. In one reduction to practice of the invention, the low frequency protection circuit was coupled only to the solid state switch in mode selection control 30 which was commensurate with the manual mode of operation. In the "manual" mode, the operator exercises control over the frequency of the siren output by means of a push-button type switch on the remote head 12. The closing of this "manual" push-button type control will initiate the charging of a capacitor from the DC source. The charge on the capacitor is applied, via the switch in control 30, to the input to oscillator 34. Accordingly, the output frequency of the siren will gradually increase as long as the "manual" switch is held closed, with the selector switch 14 in any position except RADIO, and will gradually decrease when the "manual" switch is released if selector switch 14 is in the MAN position. The low frequency protection circuit includes the RC timing circuit 46 for the manual mode and a voltage comparator 47 which compares the charge on the capacitor with a bias level from source 48 corresponding to a minimum output frequency. The output of the comparator, produced when the charge on the capacitor is equal to or below the selected minimum frequency, is the control input to the reset terminal of divider 36. Thus, the siren output of the system will be disabled if the output from oscillator 34 is at too low a frequency.

Figure 2:
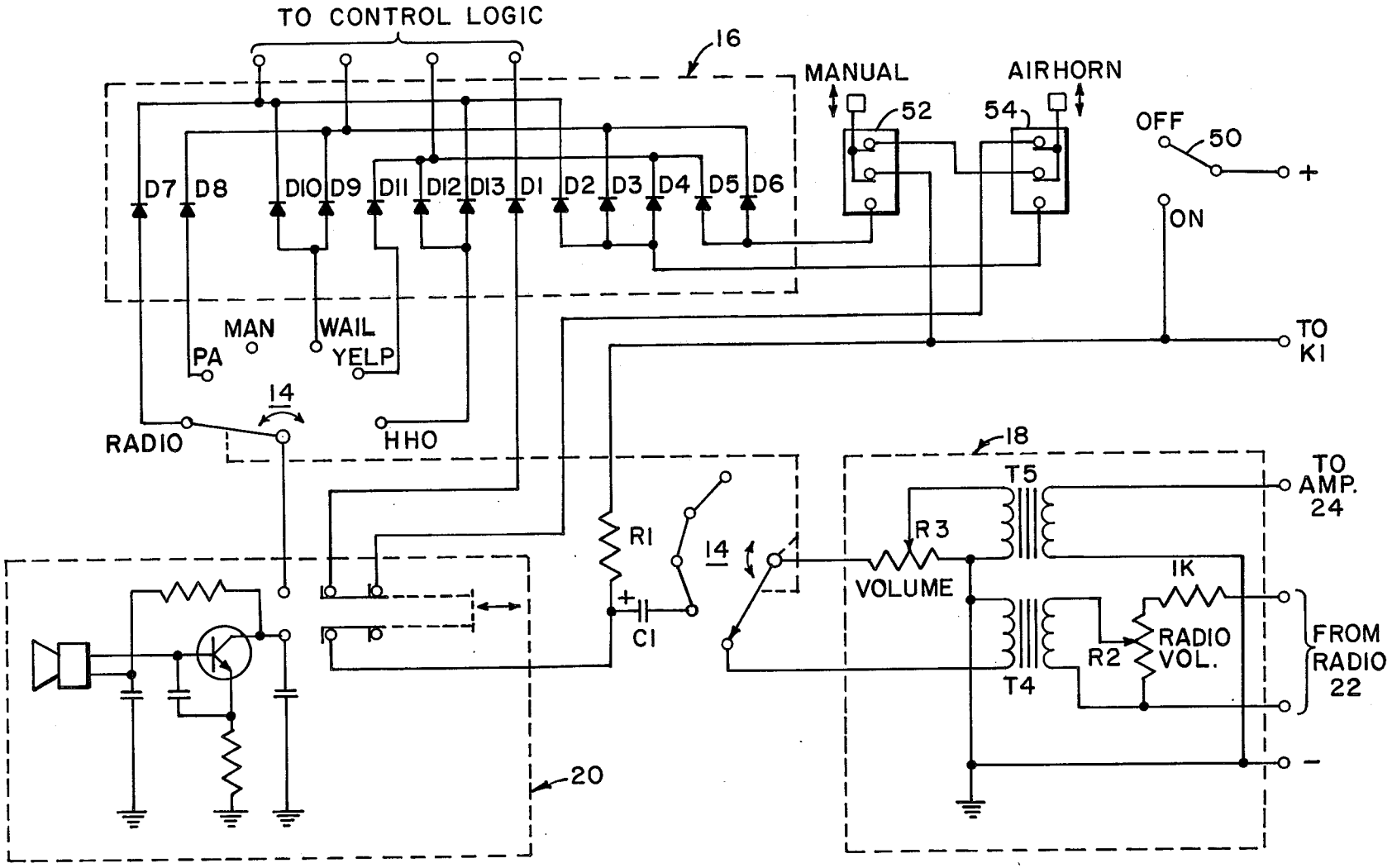
FIG. 2 is a schematic diagram of the control head of the embodiment of FIG. 1.

Referring now to FIG. 2, a schematic diagram of the remote head 12 is shown. As noted above the principal components of the remote head 12 comprise a mode selector switch 14, mode selection logic circuitry 16 and a volume control 18. The remote head also includes a system power on/off switch 50, the above-discussed manual mode tone control push-button switch 52 and an air horn simulation mode control switch 54. The mode selector switch 14, in the disclosed embodiment, comprises a pair of ganged six position rotary switches as shown. The mode selection logic circuitry 16 comprises, in the disclosed embodiment, thirteen diodes interconnected so as to provide a binary output signal on four conductors which are coupled to a BCD to decimal decoder in control logic circuit 26. A positive DC voltage will, upon closing of the main power switch 50, be applied via switches 52 and 54, the normally closed contacts of the microphone switch and switch 14 to bias diodes of logic circuit 16 into conduction. Thus, in the disclosed embodiment of the invention, the microphone is wired into the control circuit such that the selected control mode may be overriden by keying the microphone. If the microphone is not keyed, the binary output of circuit 16 will be determined solely by the setting of switch 14 except when either of push-button switches 52 or 54 is operated.

Figure 3:
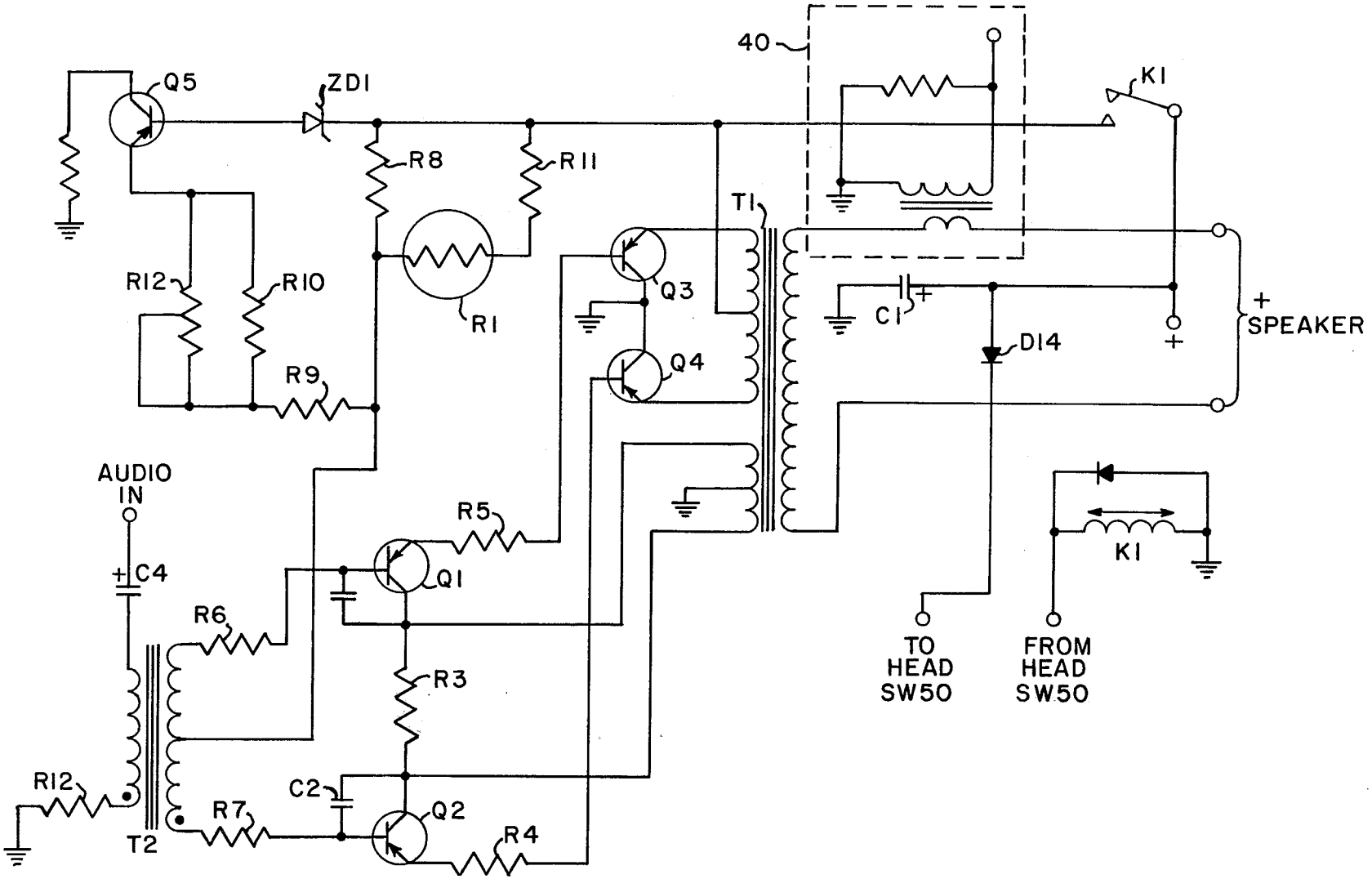
FIG. 3 is a schematic diagram of the power amplifier of the embodiment of FIG. 1.

The closing of the main power switch 50 will, as will become apparent from consideration of FIG. 3, cause current to flow through the solenoid of a relay K1 whereby the relay contacts will close and power will be applied to the system.

Operation of either of switches 52 and 54 will cause the mode selection logic circuit 16 to generate an appropriate new output. The operation of the system upon closure of switch 52 has been discussed above. Closure of switch 54 causes the siren to simulate an air horn. In the air horn mode, a switch in frequency selector 32 is closed and an amplified and buffered square wave is fed back from the output of oscillator 28 to function as Vcc for the timing capacitor in oscillator 28. With mode selector switch 14 in the "RADIO" mode shown, the system will function as a public address system which "broadcasts" the information transmitted to a radio in the vehicle. The audio output from the radio 22 is coupled via isolation transformer T4 to a first contact at the second deck of switch 14. A first volume control potentiometer R2 is connected in series with the primary winding of transformer T4. Potentiometer R2 is adjusted to match the radio input level to the microphone output level to thereby prevent overdrive of the amplifier 24, with resultant distortion, when in the "radio" mode. Potentiometer R2 is adjusted upon installation and is not on the operator's control panel. The signal induced in the secondary winding of transformer T4 is delivered via switch 14 and the operator adjusted volume control potentiometer R3 to the primary winding of a second isolation transformer T5. The voltage induced in the secondary winding of transformer T5 is delivered as an input to the power amplifier. If switch 14 is moved to the PA position, the audio output from the microphone 20 will be applied to the primary winding of transformer T5 via volume control R3. The capacitor C1 isolates the primary windings of transformers T4 and T5 from the power source.

Referring now to FIG. 3, the output of power amplifier 24 in accordance with the preferred embodiment of the present invention is shown schematically. As used herein, the term "power amplifier module" refers to power amplifier 24 and all of those additional subsystems which are not included within head 12 with the exception of speaker 10, microphone 20 and radio 22. Amplifier 24 includes a pair of power transistors Q3 and Q4 connected in a push-pull configuration across the primary winding of output transformer T1. The speaker 10 will be connected across the secondary winding of transformer T1. Transformer T1 also has a feedback winding for the purpose to be described below. The audio input signal, either from the divider circuit 36 or from a microphone or radio as passed through remote head 12, is coupled to amplifier 24 via an input transformer T2. Thus, audio frequency input signals to the power amplifier, particularly signals commensurate with the voltages induced in the secondary winding of transformer T2 as developed across resistors R6 and R7, are delivered to the base electrodes of transistors Q1 and Q2. Transisters Q1 and Q2 are connected as emitter followers and share a common collector resistor R4. In a voice mode; i.e., when the amplifier 24 is receiving signals produced either by the microphone 20 or the radio 22, the transistors Q1 and Q2 pass the audio frequency signals to the base electrodes of transistors Q3 and Q4 comprising the push-pull power amplifier. In other words, when in a voice mode, the power amplifier is operated as a conventional class B audio amplifier. However, when the system is operated in one of the siren modes the input to amplifier 24 will be overdriven and there is a significant level of current flow through transistors Q3 and Q4 on a "continuous" basis. This produces a significant danger of overheating and thus damage to transistors Q3 and Q4. The possibility of overheating results from the fact that Q3 and Q4 could not, prior to the present invention, be driven into saturation hard enough to reduce the losses across the transistors. In a typical case, the power amplifier will have a 200 watt output. The current flow through transistors Q3 and Q4 at such a high power level would, if the semi-conductors were not driven into saturation, result in significant power dissipation and thus heating of Q3 and Q4.

In accordance with the present invention, transistors Q3 and Q4 are driven hard into saturation when the amplifier input is overdriven commensurate with operating in the siren mode. This is accomplished by employing the feedback winding of transformer T1. Transistors Q1 and Q2 are incorporated in the circuit to provide current gain and stability. The collectors of transistors Q1 and Q2 would, in normal operation, be approximately at ground potential when these transistors are biased fully into conduction by "high level" input signals commensurate with a siren input. Ground potential at the collector of transistor Q1, for example, would provide insufficient base drive to transistor Q3 to force Q3 into saturation. However, by producing a voltage on the collector of Q1 which will go more negative than ground, transistor Q3 can be driven into saturation. The voltage induced in the feedback winding of transformer T1 increases as the amplifier power output increases and, with maximum power out, a voltage which alternates between −3 volts and +3 volts will appear at each end of the feedback winding of T1. Application of a −3 volt signal to the collector of transistor Q1 will drive this transistor into saturation thus forcing its emitter voltage below ground. The base voltage of Q3 will, accordingly, similarly be driven to a negative potential thereby causing transistor Q3 to conduct harder and reducing its emitter voltage to approximately 0.4 volts. The same operation, of course, occurs with transistors Q2 and Q4. With a voltage drop of only approximately 0.4 volts across transistors Q3 and Q4 at maximum power out, the power which must be dissipated across these transistors is reduced and the danger of overheating is thus similarly reduced. The capacitors C2 and C3 of respective emitter followers Q1 and Q2 prevent high frequency oscillation while the resistors R4 and R5 function as buffers to take up surge current.

A further novel feature of power amplifier 24 is the provision of a bias to emitter followers Q1 and Q2 from a constant current source. This constant current source is comprised of a transistor Q5 which has its base connected to the positive DC source for the system via a Zener diode ZD1. The bias voltage resulting from the current flow through transistor Q5 will be constant since the transistor base voltage is maintained constant by ZD1. This bias voltage is developed across the resistor network comprising potentiometer R12 and resistors R9 and R10. The bias voltage, once adjusted, will remain substantially constant and will minimize distortion since the bias level is selected, by adjusting R12 to turn the amplifier off when in a standby mode. A temperature compensation circuit comprising resistors R11 and R13 and a thermistor R14 is also included in the amplifier to provide for temperature stability. Thermistor R14 causes the bias to be reduced as temperature increases.

Referring now to FIG. 4, a schematic diagram of the "remote control switch" 42 is shown. The "remote control switch" 42 is a signal conditioning circuit comprising an optic coupler 60. As is well known, an optic coupler will comprise a pair of photo diodes connected in a back-to-back arrangement whereby one of the photo diodes will conduct, and thus emit light, if either a positive or negative voltage of sufficient magnitude is impressed across the input terminals of the optic coupler. In accordance with the present invention, by means of a voltage divider comprising resistors R14 and R15, a bias voltage at a level of onehalf of the supply voltage will be applied to a first input terminal of coupler 60. The vehicle horn ring, or other operator controllable switch, is connected, via resistor R16, to the other side of the diodes in optic coupler 60. Accordingly, the closing of the operator control switch will, depending upon the vehicle electrical system, cause the application of either a positive or negative voltage across the photo diodes of sufficient magnitude to cause one of the diodes to conduct. The conduction of one of the photo diodes will be sensed by the transistor in optic coupler 60 whereby this transistor will be biased into conduction thus generating a further input signal for the control logic 26. This further input to logic 26 will, in the manner described above, cause the nature of the siren output to change.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for generating an electrical signal which varies at an audible frequency comprising:

controllable oscillator means;

remote control means, said remote control means including a mode selector switch and encoder means for generating a binary coded output signal commensurate with the setting of said mode selector switch;

decoder means, said decoder means being located remotely from said remote control means and being responsive to the coded output of said remote control means for generating a plurality of gate control signals;

means delivering the coded output of said remote control means to said decoder means;

gate circuit means responsive to the control signals generated by said decoder means, said gate circuit means including switch means connected to said oscillator means, said gate circuit means changing the frequency and rate of change of frequency of said oscillator means output signal commensurate with the setting of said remote control means mode selector switch;

amplifier means;

means applying said oscillator means output signals as the input signal to said amplifier means; and means for delivering signals amplified by said amplifier means to a loudspeaker.

2. The apparatus of claim 1 wherein said oscillator means comprises:

a first oscillator, said first oscillator simultaneously producing output signals having at least two wave forms, said first oscillator output signals being variable between a plurality of preselected frequencies in response to the gate control signals of said decoder means;

a voltage controlled oscillator, said voltage controlled oscillator generating output pulses at a repetition rate commensurate with the magnitude of an input signal delivered thereto, the output signals of said first oscillator being selectively delivered as input signals to said voltage controlled oscillator under the control of said decoder means; and means responsive to the pulses generated by said voltage controlled oscillator means for producing a symmetrical alternating signal at a frequency which varies with the output frequency of said voltage controlled oscillator.

3. The apparatus of claim 2 further comprising:

means for manually varying the output frequency of said oscillator means, said manual frequency varying means including:

manual switch means, said manual switch means providing a steady state output signal when in the closed condition, said manual switch means being connected to said remote control means encoder means whereby the closing of said manual switch means will cause the coded output signal of said remote control means to vary;

timing circuit means, said timing circuit means being responsive to the state of said gate circuit means commensurate with the coded output signal of said remote control means corresponding to closing of said manual switch means to provide a voltage which varies with time, said time varying voltage being applied by said gate circuit means to said voltage controlled oscillator;

comparator means, said comparator means comparing the output of said timing circuit means with a preselected bias voltage level commensurate with a minimum oscillator output frequency, said comparator means providing an output signal when said oscillator output frequency reaches the said minimum; and means for disabling said oscillator means in response to said comparator means output signals.

4. The apparatus of claim 3 further comprising:

means responsive to input signals of either polarity for generating command signals;

bistable circuit means responsive to said command signals for generating a further gate control signal; and means for delivering said further gate control signal to said gate circuit means to cause the output of said oscillator means to change.

5. The apparatus of claim 4 wherein said remote control means further comprises:

means responsive to the closing of a switch in a microphone, the microphone being coupled to said remote control means, for applying a further input signal to said encoder means whereby said encoder means will generate a binary signal commensurate with the disabling of said oscillator means;

means for passing audio frequency signals provided from a microphone, said signal passing means including a variable attenuator; and means for delivering said passed signals to said amplifier means regardless of the position of said mode selector switch.

6. The apparatus of claim 1 wherein said remote control means further comprises:

means responsive to the closing of a switch in a microphone, the microphone being coupled to said remote control means, for applying a further input signal to said encoder means whereby said encoder means will generate a binary signal commensurate with the disabling of said oscillator means;

means for passing audio frequency signals provided from a microphone, said signal passing means including a variable attenuator; and means for delivering said passed signals to said amplifier means regardless of the position of said mode selector switch.

7. The apparatus of claim 1 further comprising:

means responsive to input signals of either polarity for generating command signals;

bistable circuit means responsive to said command signals for generating a further gate control signal; and means for delivering said further gate control signal to said gate circuit means to cause the output of said oscillator means to change.

8. The apparatus of claim 1 wherein said amplifier means comprises:

an output transformer, said transformer including a centertaped primary winding, a secondary winding and a feedback winding, said feedback winding being connected to said means for delivering signals to a loudspeaker;

a pair of output transistors, said output transistors each including a base, a collector and an emitter, said output transistors and said transformer primary winding being connected to define a push-pull amplifier stage;

preamplifier means, said preamplifier means including first and second drive transistors connected as emitter followers, the emitters of said drive transistors being respectively coupled to the base of an output transistor, the bases of said drive transistors being connected to said means for applying oscillator means output signals to said amplifier means; and means connecting the collectors of said drive transistors to respectively opposite ends of said transformer feedback winding, the voltages appearing at the emitters of said drive transistors being commensurate with the associated collector voltage and each having a polarity which will increase conduction of the associated output transistor, said voltages increasing with the average magnitude of the oscillator means output signals applied to the bases of said drive transistors whereby said output transistors will be driven into saturation with input signals of greater than a predetermined magnitude.

9. The apparatus of claim 8 wherein said drive transistors share a common collector resistor.

10. The apparatus of claim 9 wherein said means applying said oscillator means output signals as the input signal to said amplifier means includes:

an input transformer having a primary winding and a secondary winding, opposite ends of said input transformer secondary winding being connected to respective of said drive transistor bases, said oscillator means output signals being applied to said input transformer primary winding.

11. The apparatus of claim 10 wherein said input transformer secondary winding is center-tapped and said apparatus further comprises:

a source of constant current; and variable resistance means connected between said input transformer second winding center-tap and said constant current source whereby a constant bias voltage will be applied to said drive transistors.

12. The apparatus of claim 8 further comprising:

means for applying a bias voltage to said drive transistor bases, said bias voltage applying means including a constant current source and resistor means connected to said current source for developing a bias voltage whereby said drive transistors will be non-conductive in the abscence of an input signal from said oscillator means.

* * * * *